US008573742B2

(12) United States Patent
Petersen et al.

(10) Patent No.: US 8,573,742 B2
(45) Date of Patent: Nov. 5, 2013

(54) WIPER BUMPER FOR A FLUID DISPENSING COMPONENT

(75) Inventors: Daniel W. Petersen, Philomath, OR (US); James D. Plymale, Brush Prairie, WA (US); John L. Taylor, Corvalis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 302 days.

(21) Appl. No.: 12/812,754

(22) PCT Filed: Feb. 14, 2008

(86) PCT No.: PCT/US2008/054004

§ 371 (c)(1),
(2), (4) Date: Jul. 14, 2010

(87) PCT Pub. No.: WO2009/102333

PCT Pub. Date: Aug. 20, 2009

(65) Prior Publication Data

US 2011/0115851 A1 May 19, 2011

(51) Int. Cl.

| | |
|---|---|
| ***B41J 2/14*** | (2006.01) |
| ***B41J 2/165*** | (2006.01) |
| ***B05B 1/00*** | (2006.01) |

(52) U.S. Cl.
USPC ..... 347/47; 347/33; 239/589

(58) Field of Classification Search
USPC ..... 347/33, 86, 47, 85
See application file for complete search history.

(56) References Cited

U.S. PATENT DOCUMENTS

| | | | | |
|---|---|---|---|---|
| 5,905,513 | A | 5/1999 | Brandon et al. | |
| 6,467,873 | B1 | 10/2002 | Toba et al. | |
| 6,817,696 | B2 * | 11/2004 | Miki et al. | 347/31 |
| 7,188,927 | B2 | 3/2007 | Anderson, Jr. et al. | |

FOREIGN PATENT DOCUMENTS

| | | |
|---|---|---|
| EP | 0956965 | 5/1999 |
| EP | 1839876 | 10/2007 |
| JP | 1275047 | 11/1989 |
| JP | 200171513 | 3/2001 |
| JP | 2001105614 | 4/2001 |
| JP | 2001-301182 | 10/2001 |
| JP | 2003001834 | 1/2003 |
| JP | 2003-080720 | 3/2003 |
| JP | 2005-028766 | 2/2005 |
| JP | 2007076295 | 3/2007 |
| JP | 2007-210131 | 8/2007 |

OTHER PUBLICATIONS

Wikipedia Article~Dihedral Angle, p. 2, 1st paragraph; Merriam-Webster Definition of Integral.*
Supplementary European Search Report for Application No. EP08729899.8. Report issued Apr. 11, 2011.

* cited by examiner

*Primary Examiner* — Lisa M Solomon

(57) ABSTRACT

In one embodiment, a component for dispensing a fluid includes: a plurality of fluid ejection orifices arrayed in a plane; and an elongated bumper extending along one side of the array generally in a plane intersecting the plane of the array and the bumper having a protruding exterior surface that includes a first part inclining away from the array and a contiguous second part inclining back toward the array.

15 Claims, 4 Drawing Sheets

WIPER BUMPER FOR A FLUID DISPENSING COMPONENT

BACKGROUND

The operation of inkjet printers sometimes results in unwanted excess ink accumulating on the printhead(s) in areas around the ink ejection orifices. Such ink accumulation may interfere with accurate ink drop ejection or otherwise adversely affect print quality. Servicing to remove excess ink from a printhead often involves wiping the orifice plate and adjacent areas with a flexible blade or other suitable wiper. The wiper moves back and forth across the orifice plate and adjacent areas, removing excess ink to areas away from the orifice plate. Wiper servicing, however, can leave waste ink accumulations at the perimeter of the wiper path still in close proximity to the print zone. After extended use this waste ink may build-up in sufficient quantity to droop or dislodge onto or otherwise contact the print media, resulting poor quality printed output.

DRAWINGS

DETAILED DESCRIPTION

Embodiments of the disclosure were developed in an effort to remove waste ink from the wiper during wiper servicing of an inkjet printhead and to keep the unwanted waste ink away from the print zone. Embodiments will be described with reference to an inkjet printhead assembly that holds replaceable ink containers. Embodiments of the disclosure, however, are not limited to such printhead assemblies, but might also be implemented in other types of printhead assemblies or ink cartridges, specifically including but not limited to ink cartridges in which the printhead assembly and the ink container are integrated into a single unit/cartridge. The use of inkjet technology for dispensing fluids other than ink is growing. Embodiments of the disclosure are also not limited to inkjet printer components, but might also be implemented in other types of fluid dispensing components. The example embodiments shown in the Figures and described below, therefore, illustrate but do not limit the scope of the disclosure.

As used in this document, "bumper" means something configured to bump or be bumped. Any directional terms such as "up" and "down", "left" and "right", "top" and "bottom", etc., are used with reference to the orientation of the component being described as shown in the applicable figure(s). Such components, however, may be oriented differently from that shown and, therefore, directional terms are used for illustration only and do not limit the scope of the disclosure.

Figure 1:
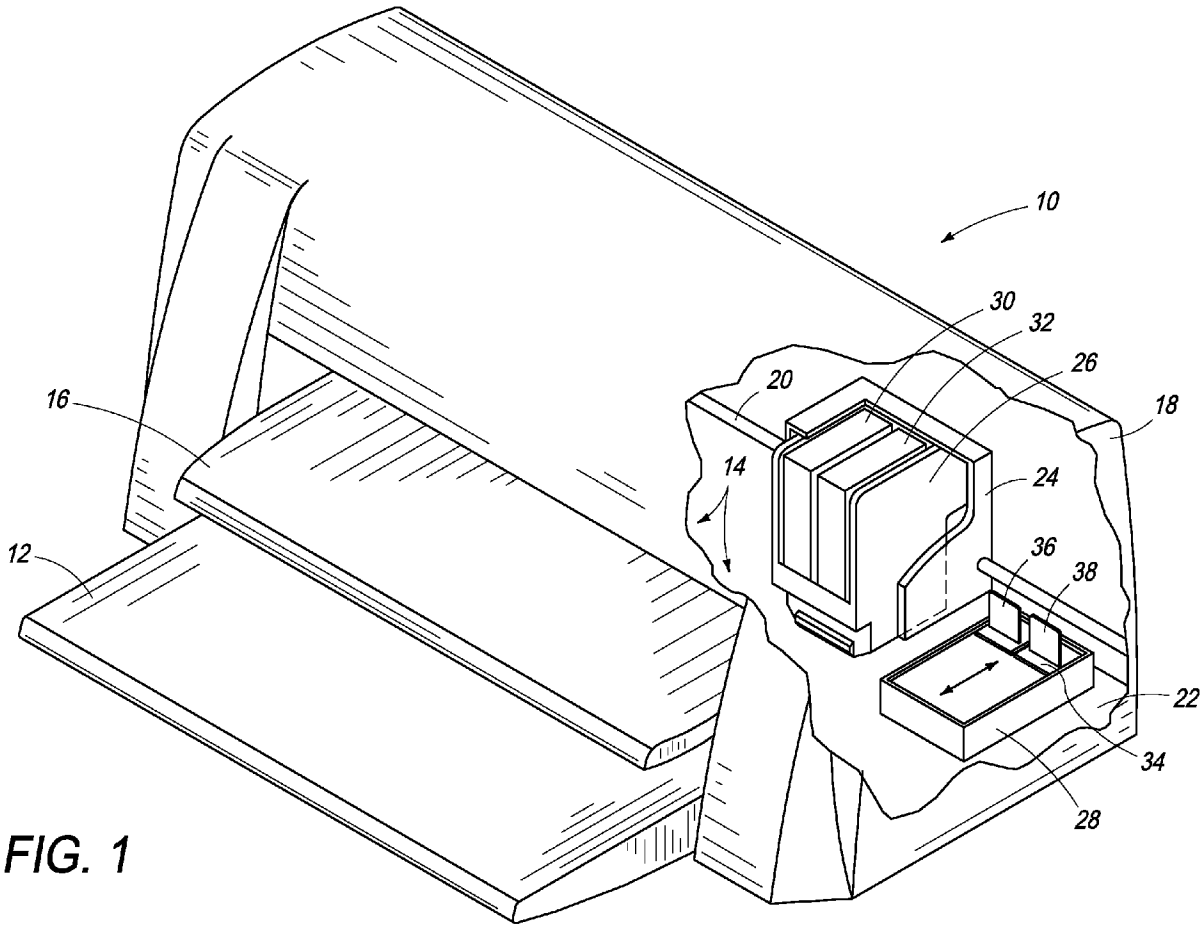
FIG. 1 is a perspective view illustrating an inkjet printer, according to one embodiment of the disclosure.

FIG. 1 illustrates an inkjet printer 10 implementing one embodiment of the disclosure. In an operating inkjet printer

10, sheets of paper or other print media are fed from a feed tray 12, through a print zone 14, to an output tray 16. Inside a printer housing 18, a guide rod 20 mounted to a chassis 22 supports a reciprocating carriage 24. Carriage 24 carries a printhead assembly 26 back and forth on guide rod 20 through print zone 14. Replaceable ink containers 30 and 32 are mounted in printhead assembly 26. A printer motor operating under the direction of an electronic controller (not shown) within housing 18 moves carriage 24 and printhead assembly 26 back and forth through print zone 14 and into and out of a service station 28. Service station 28 includes a wiper sled 34 that carries flexible wipers 36 and 38 back and forth across the face of printhead assembly 26. A service station 28 might also include capping and purging functions to prevent or clear clogged ink ejection orifices.

Figure 2:
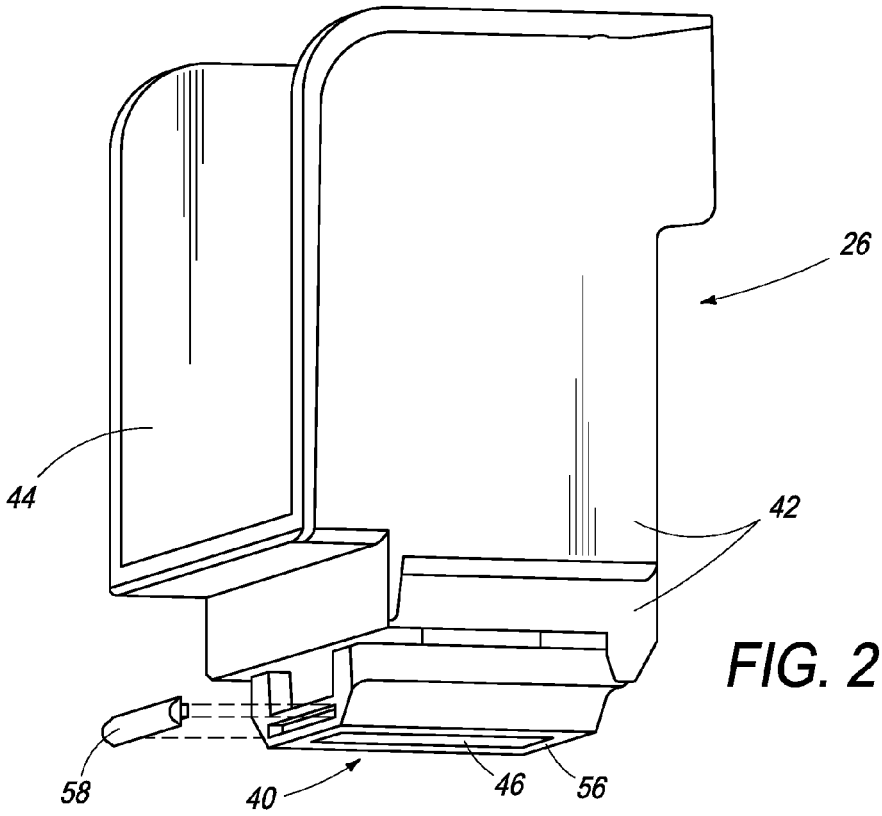
FIGS. 2 and 3 are perspective views illustrating the printhead assembly from the printer shown in FIG. 1, according to one embodiment of the disclosure.
Figure 3:
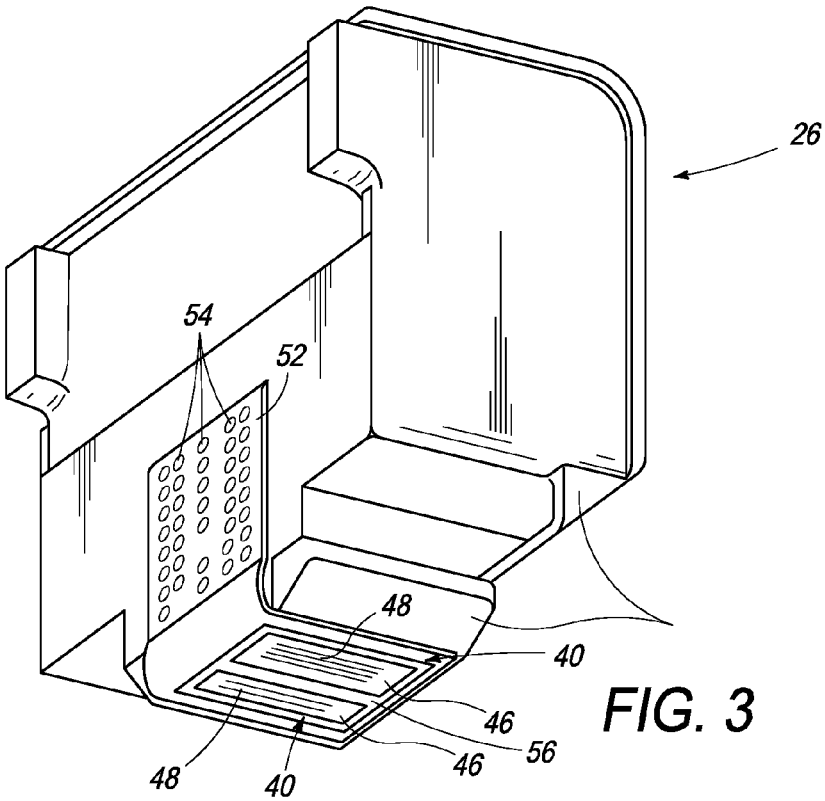

FIGS. 2 and 3 are perspective views showing in more detail printhead assembly 26 without ink containers 30 and 32. Referring to FIGS. 2 and 3, printhead assembly 26 includes a printhead 40 mounted in a body 42 of assembly 26. Printhead 40 is mounted to body 42 so that it will be located immediately adjacent to print zone 14 when printhead assembly 26 is mounted in carriage 24 in printer 10, as shown in FIG. 1. For the printer configuration shown in FIG. 1, printhead 40 is mounted at the bottom of assembly 26. Body 42 defines a bay 44 for holding one or more removable/replaceable ink containers, such as ink containers 30 and 32 shown in FIG. 1. Printhead 40 includes an orifice plate 46 with multiple arrays 48 of tiny ink ejection orifices 50. (Individual orifices 50 may be seen in FIGS. 4-7.)

In the embodiment shown, each array 48 is a single row of orifices 50. Also in the embodiment shown, printhead assembly 26 includes two orifice plates 46, each corresponding to a printhead 40 associated with each ink container 30 and 32. In one such dual printhead configuration, ink container 30 might contain three different colored inks, typically cyan, magenta and yellow, and ink container 32 might contain a single colored ink, typically black. Each printhead 40 may be constructed separately as a discrete die or the two printheads 40 may be constructed as an integral unit on a single die. Other configurations are possible. For example, orifice rows 50 could be staggered and a separate container used for each color ink.

In a thermal inkjet printer, firing resistors formed on an integrated circuit chip as part of each printhead 40 are positioned behind orifice plate 46. A flexible circuit 52 carries electrical traces from external contact pads 54 to the firing resistors. When printhead assembly 26 is installed in printer 10 (FIG. 1), printhead assembly 26 is electrically connected to the printer controller through contact pads 54. In operation, the printer controller selectively energizes the firing resistors through the signal traces in flexible circuit 52 to eject drops of ink through orifices 50. In a piezoelectric inkjet printer, piezoelectric firing elements are used instead of thermal resistors to eject ink drops.

Figure 4:
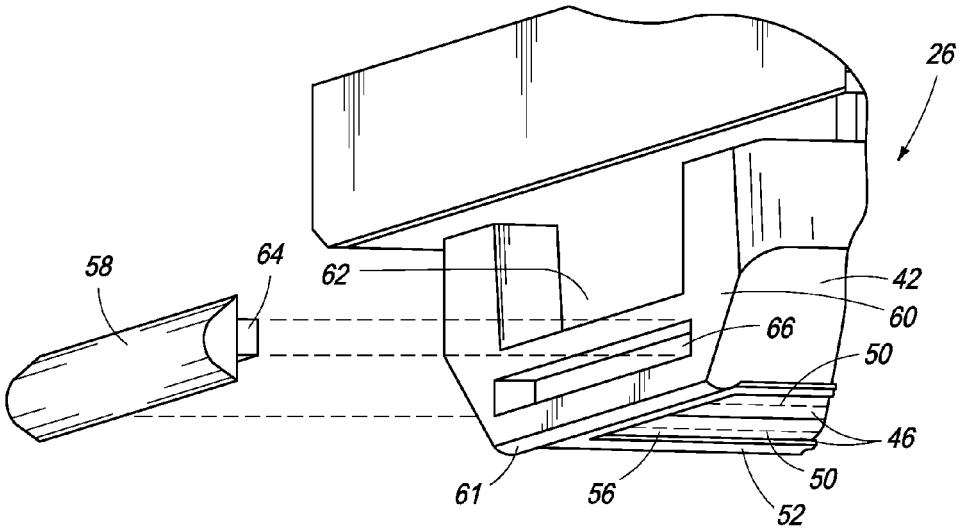
FIG. 4 is a detail, exploded view showing the wiper bumper on the printhead assembly of FIGS. 2 and 3.
Figure 5:
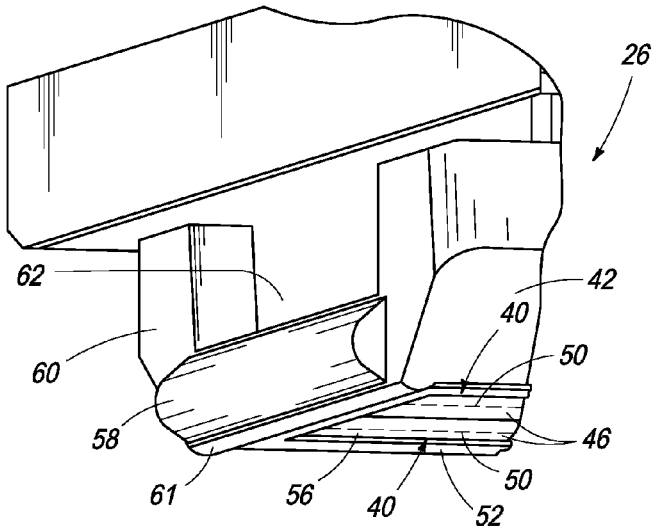
FIG. 5 is a detail view (not exploded) showing the wiper bumper on the printhead assembly of FIGS. 2 and 3.
Figure 6:
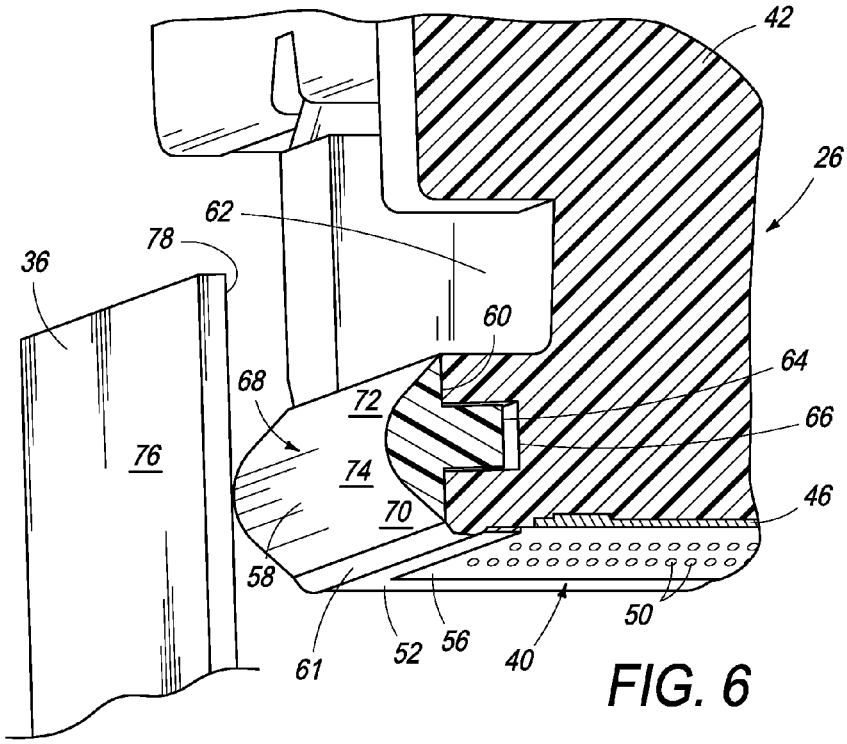
FIG. 6 is a detail partial section view showing the wiper bumper on the printhead assembly of FIGS. 2 and 3.
Figure 7:
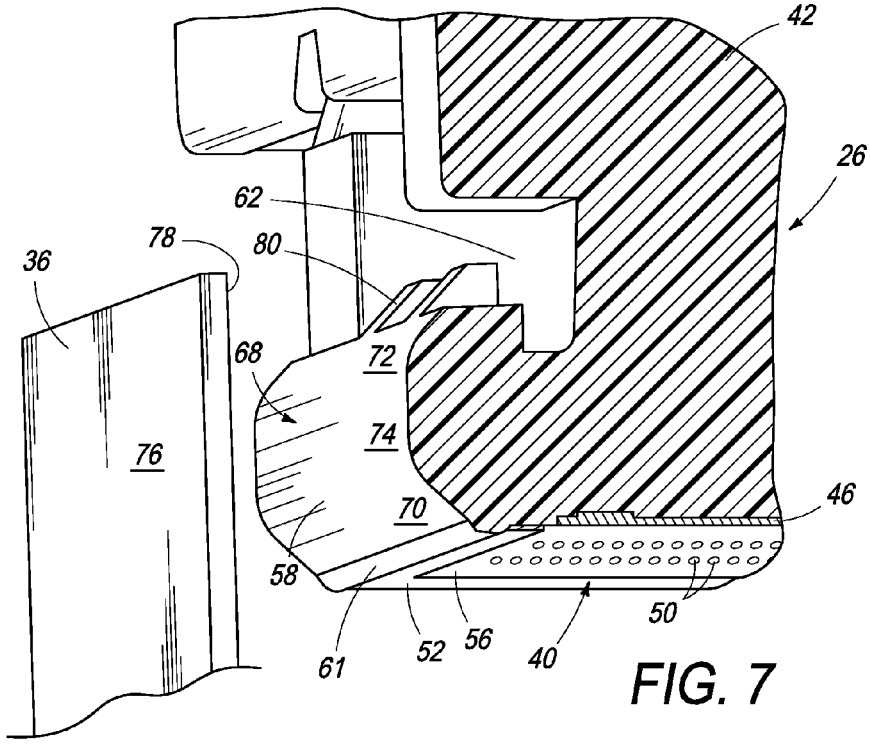
FIG. 7 is a detail partial section view showing a second embodiment of a wiper bumper for a printhead assembly such as the one shown in FIGS. 2 and 3.

Referring now also to the detail views of FIGS. 4-6, orifice plates 46 generally define a face 56 along the bottom of printhead assembly 26. As noted above, each printhead 40 and, correspondingly, each orifice plate 46 is mounted to assembly body 42. Part of body 42 will typically extend around orifice plates 46 as part of face 56. Also, orifice plates 46 may be positioned adjacent to those portions of flex circuit 52 that extend along the bottom of assembly 26, as shown in FIG. 3, and/or recessed slightly into body 42. Face 56, therefore, may not be perfectly flat or smooth. Thus, face 56 defines a generally planar surface extending along orifice plates 46. (For clarity due to the small size of orifice plates 46 in the perspective views of FIGS. 4 and 5, only one row of orifices 50 on each orifice plate 46 is shown.)

A wiper bumper 58 extends across one side 60 of body 42 at one end of face 56. Side 60 is generally perpendicular to face 56. Although side 60 may intersect face 56 at other angles, more or less than 90°, the problem of handling waste ink is more difficult when side 60 and face 56 intersect one another at a relatively sharp corner, as is quite common. A contoured rail 61 across the end 62 of face 56 may be used to help protect the edge of flex circuit 52 and to provide a smooth transition for wiper 36 (FIG. 6) between face 56 and bumper 58. Waste ink removed from wiper 36 may accumulate in a cavity 62 immediately above bumper 58 away from face 56 and, accordingly, away from print zone 14 when printhead assembly 26 is installed in printer 10 (FIG. 1). In the absence of bumper 58 and cavity 62, waste ink would tend to accumulate on face 60 near its intersection with face 56. Waste ink accumulated in this area on face 60, which is very close to the print zone, is more likely to dislodge and fall into the print zone than waste ink accumulated either in cavity 62 or on the upper face 72 of bumper 58.

Bumper 58 may be a separate part affixed to assembly body 42, as shown in FIGS. 4-6, or bumper 58 may be formed as an integral part of assembly body 42. In the embodiment shown in FIGS. 4-6, bumper 58 is properly positioned in body 42, for example, by means of a key 64 projecting from the back side of bumper 58 and a mating keyway 66 in body 42. The use of a mating key/keyway or other suitable assembly structure also helps maintain bumper 58 in the proper position throughout the numerous wiping operations that occur over the life of printhead assembly 26. Exterior surface 68 on bumper 58 includes a lower part 70 that inclines up and away from face 56, an upper part 72 that inclines up and back in toward face 56, ending at cavity 62, and an apex part 74 joining lower part 70 and upper part 72.

It is desirable to size and shape bumper 58 so that: (1) inclining exterior surface lower part 70 moderates the otherwise abrupt edge at the end of face 56 as wiper 36 moves to the left in FIG. 6, smoothing the transition from the wiped surfaces on face 56 to subdue ink flicking off left-side wiper face 76; (2) apex part 74 intercepts wiper 36 low enough when wiper 36 is moving to the right in FIG. 6 to remove wiped ink that accumulates on right-side wiper face 78 (which is ink wiped from face 56 as wiper 36 moves left to right in FIG. 6); and (3) ink accumulating on bumper 58 moves up along inclined exterior surface upper part 72 toward cavity 62 as wiper 36 repeatedly bumps bumper 58. For example, for a wiper 36 that extends about 4 mm above face 56, typical in some inkjet printer service stations, it is expected that a bumper 58 2-4 mm high (the direction perpendicular to the plane of face 56), protruding 1-4 mm from side 60 at apex part 74 between 45° inclining parts 70 and 72 will subdue ink flicking, remove ink accumulating on wiper face 76, and move that ink toward cavity 62.

The location and shape of the print media is usually well controlled by feed/pinch rollers so that it remains flat as it enters the print zone and begins to pass under face 56, but may not remain flat at the end of the print zone opposite the pinch rollers. (The print media passes under face 56 moving from right to left in FIGS. 2 and 4-7.) The pinch rollers contact dry media just upstream from the print zone while at the other end of the print zone the printed media may be heavily wetted with ink and can swell and cockle (undulating wrinkles). Additionally, the shape and location of the wetted print media at the end of the print zone opposite the pinch rollers is more difficult to control. Thus, it is more likely the print media will contact any waste ink which, in the absence of bumper 58, could accumulate along the lower edge of side 60. Bumper 58 helps prevent waste ink from accumulating along the lower edge of side 60. The action of wiper 76 on bumper surface parts 70 and 74 helps keep ink from accumulating on those surfaces, reducing the risk of waste ink contacting print media in the print zone.

In the embodiment shown in FIGS. 4-6, apex part 74 transitions over a short distance between lower part 70 and upper part 72 to form a bulbous bumper 58 in which lower part 70 and upper part 72 are about the same length and incline at about the same angle. Other configurations are possible. For example, in an alternative embodiment shown in FIG. 7, the apex part 74 of bumper 58 extends for a long distance, about the same as the length of each inclined part 70 and 72, to isolate waste ink further from the print zone. Ribs 80 along the top of bumper 58 may be used to strengthen bumper 58. Also in the embodiment shown in FIG. 7, bumper 58 is formed as an integral part of assembly body 42, and cavity 62 is recessed down into body 42 below the top surface of bumper 58 to increase the volume of space available away from the pint zone to hold waste ink. For another example, it may be desirable in some embodiments to provide a more abrupt apex (part 74) for scraping ink from wiper 76.

The present disclosure has been shown and described with reference to the foregoing example embodiments. It is to be understood, however, that other forms, details and embodiments may be made without departing from the spirit and scope of the disclosure which is defined in the following claims.

What is claimed is:

1. A component for dispensing a fluid, comprising:

a body having a face and a side intersecting the face;

a plurality of fluid ejection orifices arrayed in a plane along the face of the body; and an elongated bumper extending along and protruding from the side of the body along one side of the array generally in a plane intersecting the plane of the array and the bumper having a protruding exterior surface that includes a first part inclining away from the array, a contiguous second part inclining back toward the array, and an apex part connecting the first part and the second part, wherein the apex part points in a direction that is parallel to the plane of the array, and wherein the side of the body intersects the face of the body at a corner and the first part of the exterior surface of the bumper inclines away from the array beginning at or near the corner.

2. The component of claim 1, wherein the plane of the bumper intersects the plane of the array at substantially a right angle.

3. The component of claim 1, wherein the first part of the exterior surface of the bumper inclines away from the array beginning at or near the intersection of the plane of the bumper and the plane of the array.

4. The component of claim 1, wherein the first part of the exterior surface of the bumper inclines away from the array beginning at a location substantially contiguous with the plane of the array.

5. The component of claim 1, further comprising:

a plate affixed to the body along the face, the fluid ejection orifices located in the plate.

6. The component of claim 5, wherein the first part of the exterior surface of the bumper inclines away from the array beginning at a location substantially contiguous with the intersection of the face of the body and the side of the body.

7. The component of claim 5, wherein the bumper comprises a bulbous protrusion protruding from the side of the body.

8. The component of claim 5, wherein the bumper comprises an integral part of the side of the body.

9. The component of claim 5, further comprising a cavity in the body adjoining the second part of the exterior surface of the bumper.

10. A component for dispensing a fluid, comprising:

a body having a face and a side generally perpendicular to the face, wherein the face extends along a plane;

a plate affixed to the face defining an array of fluid ejection orifices; and a bumper extending along and protruding from the side of the body, the bumper having an exterior surface that includes a first part inclining away from the side, a contiguous second part inclining back toward the side, and an apex part connecting the first part and the second part, wherein the apex part points in a direction that is parallel to the plane of the face, the body also having a cavity located in the side of the body adjacent to and extending lengthwise along the second part of the exterior surface of the bumper.

11. A component for dispensing a fluid, comprising:

a body having a face defining an array of fluid ejection orifices and a side intersecting the face; and an elongated bumper extending along the side of the body, the bumper having a dihedral angled exterior surface protruding from the side of the body, wherein the dihedral angled exterior surface includes a first part inclining away from the array, a contiguous second part inclining back toward the array, and an apex part connecting the first part and the second part, wherein the apex part points in a direction that is parallel to the plane of the array, and wherein the first part of the exterior surface of the bumper inclines away from the array beginning at a location substantially contiguous with the intersection of the face of the body and the side of the body.

12. An inkjet printhead assembly, comprising:

a body having a cavity;

a orifice plate affixed to the body, the orifice plate having an array of ink ejection orifices therein exposed at a generally rectangular face on the body, wherein the orifice plate extends along a plane; and an elongated bulbous protrusion fronting one side of the face, the protrusion having a lengthwise dimension extending along the side of the face, a lateral dimension generally perpendicular to the lengthwise dimension, and an exterior surface that includes, along the lateral dimension, a first part inclining away from the side of the face, a contiguous second part inclining back toward the side of the face, and an apex part connecting the first part and the second part, wherein the apex part points in a direction that is parallel to the plane of the orifice plate, wherein the cavity of the body adjoins the second part of the exterior surface of the bumper.

13. The inkjet printhead assembly of claim 12, wherein the exterior surface includes a convex curvilinear surface.

14. The inkjet printhead assembly of claim 12, wherein the exterior surface includes a dihedral angled surface.

15. The inkjet printhead assembly of claim 12, wherein the bumper comprises an integral part of the body.

* * * * *